US006543430B2

(12) United States Patent
Moga et al.

(10) Patent No.: US 6,543,430 B2
(45) Date of Patent: Apr. 8, 2003

(54) CASSETTE FOR IGNITION COILS AND METHOD OF JOINING

(75) Inventors: Viorel N. Moga, Anderson, IN (US); Ronald M. Eicher, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/878,771

(22) Filed: Jun. 11, 2001

(65) Prior Publication Data

US 2002/0185118 A1 Dec. 12, 2002

(51) Int. Cl.[7] ..... F02P 11/00
(52) U.S. Cl. ..... 123/634; 29/464
(58) Field of Search ..... 123/634, 594, 123/635; 29/464

(56) References Cited

U.S. PATENT DOCUMENTS 5,125,386 A * 6/1992 De Filippis et al. ..... 123/634
6,386,189 B2 * 5/2002 Shimada et al. ..... 123/634

FOREIGN PATENT DOCUMENTS

| | | |
|---|---|---|
| EP | 1146227 | 10/2001 |
| GB | 2339596 | 2/2000 |
| JP | 2002026656 | 1/2001 |

* cited by examiner

*Primary Examiner*—Bibhu Mohanty
(74) *Attorney, Agent, or Firm*—Margaret A. Dobrowitsky

(57) ABSTRACT

A method and apparatus for securing at least one ignition coil to an ignition coil cassette, the ignition coil cassette having a main body portion being adapted to receive and engage a plurality of coils for generating a high voltage signal to be received by a spark plug of an internal combustion engine. The coils being ultrasonically welded to the main body portion of the ignition coil cassette. The coils being secured in a manner which correctly positions the coils in an appropriate location as well as providing a rigid securement of the coil to the main body portion.

15 Claims, 7 Drawing Sheets

CASSETTE FOR IGNITION COILS AND METHOD OF JOINING

TECHNICAL FIELD

The present application relates to an ignition coil cassette having a plurality of coils for an internal combustion engine. More particularly, the present application relates to an ignition coil cassette and method of joining the ignition coils to the cassette.

BACKGROUND

An ignition system for an internal combustion engine provides spark to engine cylinders in a controlled manner. Some ignition systems include spark plugs, a high voltage coil and a distributor that directs high voltage power through spark plug wires to the spark plugs. Distributorless systems rely upon microprocessors to more precisely control engine operation. In such systems, the distributor is eliminated and a microprocessor controls engine operation based upon data generated as a result of engine operation.

Systems which utilize a distributor only require a single coil for four, six or eight cylinders, while a distributorless ignition system, utilizes a plurality of coils, for example, one coil to develop a high voltage output for each spark plug.

In addition, and in a distributorless system, modular groups of ignition parts connect an ignition coil or coils to several spark plugs simultaneously. A single unit can be provided to house the components of an ignition system. The single unit provides advantages when servicing an ignition system. A mass produced part can be quickly removed and replaced. The replacement part can be fully checked for purposes of quality control resulting in improved reliability and customer service.

A single distribution cassette including a plurality of coils requires the components to be sealed within the unit to protect the individual components from deterioration due to moisture or operation under harsh conditions.

SUMMARY

An ignition coil cassette, having a main body portion with a plurality of openings for receiving a plurality of coils, the plurality of coils are ultrasonically welded to the main body portion and provide a high voltage signal to spark plugs of an internal combustion engine.

An apparatus for securing a plurality of coils to an ignition coil cassette, the apparatus includes a cassette support for supporting a main body portion of the cassette and the cassette support maintains the position of the main body portion during the securement of the coil. A fixture support having a guide pin for aligning the coil with respect to the main body portion, the guide pin is adjustable with respect to the entire fixture moves to shuttle each coil under the ultrasonic weld horn for welding. The apparatus includes an ultrasonic welding machine for welding the coils to the cassette.

A method for producing an ignition coil cassette, including: inserting a coil through an aperture in a body portion of the ignition coil cassette; and ultrasonically welding the coil to the body portion.

The above-described and other features and advantages of the present invention will be appreciated and understood by those skilled in the art from the following detailed description, drawings, and appended claims.

DESCRIPTION OF THE PREFERRED EMBODIMENT

Figure 1:
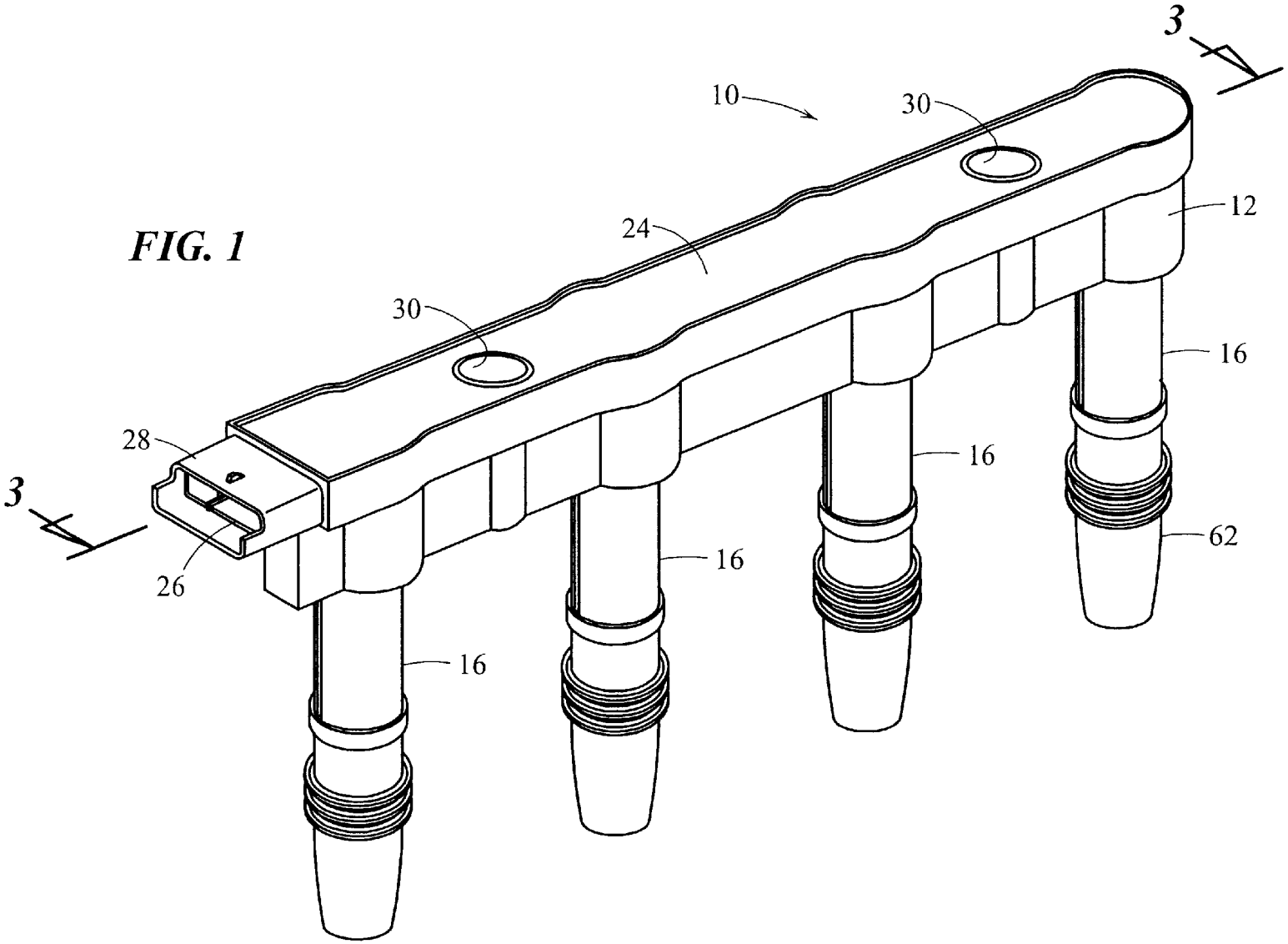
FIG. 1 is a perspective view of a coil assembly constructed in accordance with an exemplary embodiment of the present invention.
Figure 2:
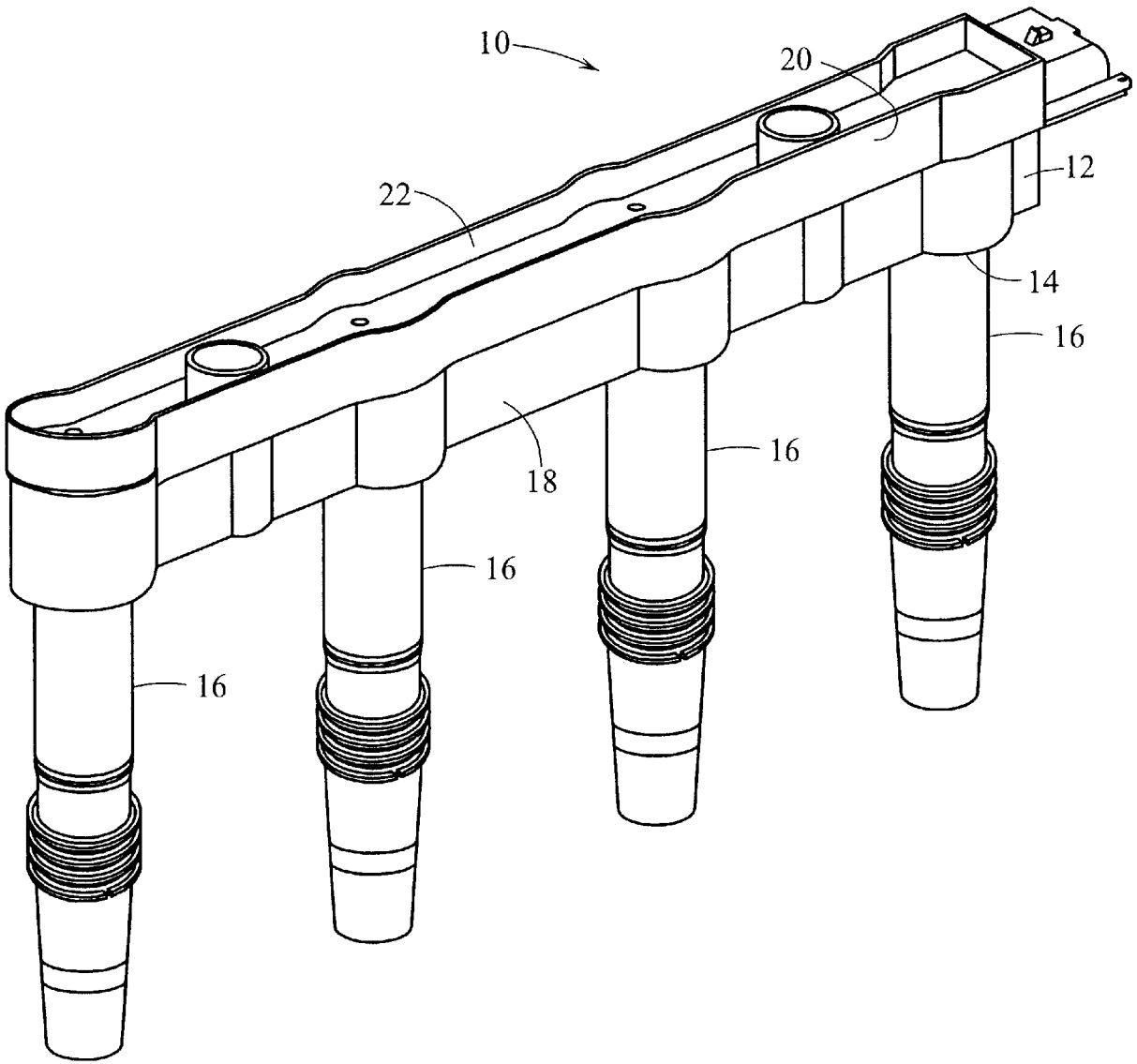
FIG. 2 is a partial perspective view of a coil assembly constructed in accordance with an exemplary embodiment of the present invention.
Figure 3:
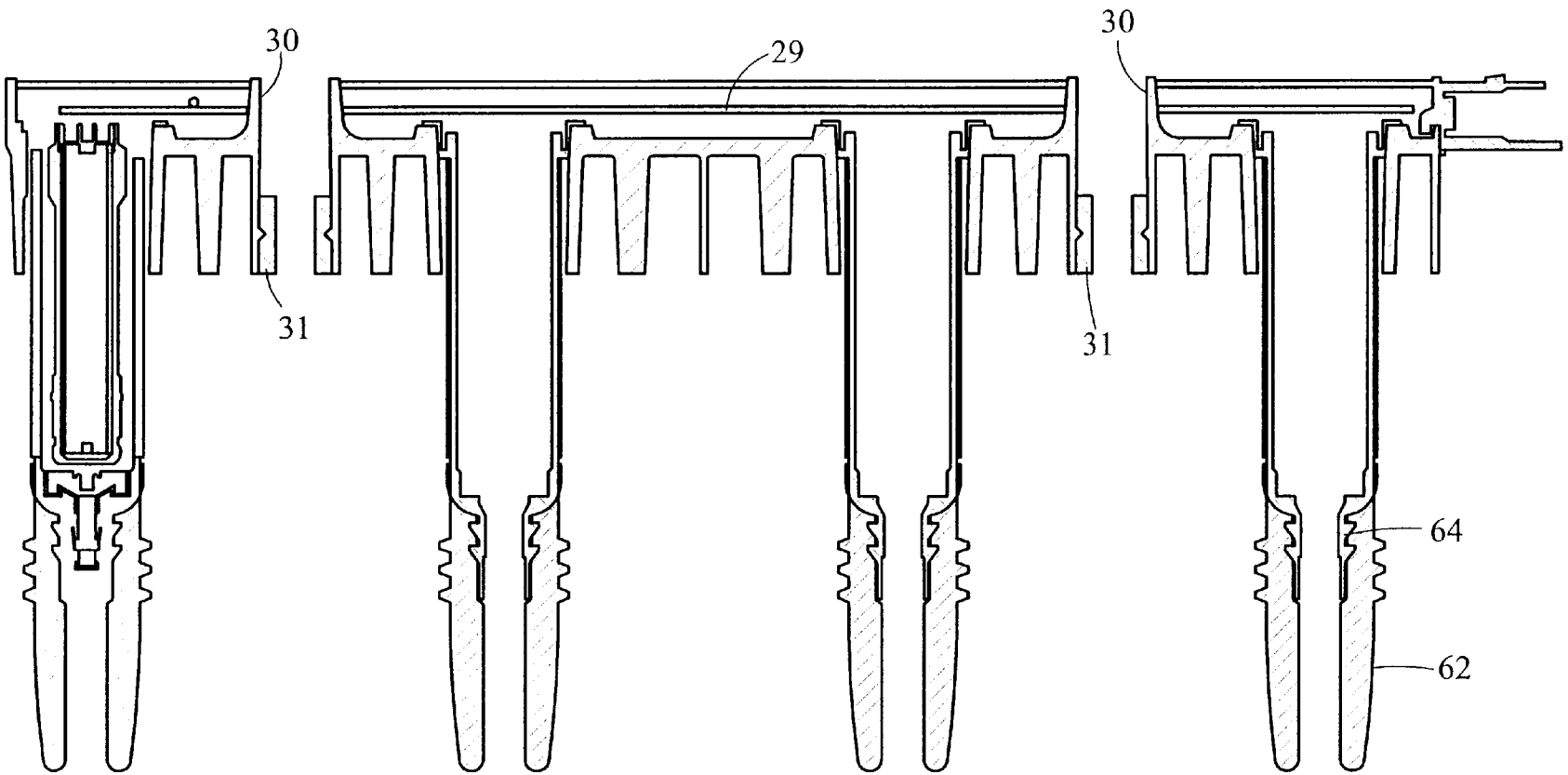
FIG. 3 is a view along lines 3—3 of FIG. 1.

Referring now to FIGS. 1–4, a cassette 10 constructed in accordance with an exemplary embodiment of the present invention is illustrated. In an exemplary embodiment, cassette 10 is constructed out of a lightweight, easily moldable material such as plastic or polymers.

Cassette 10 includes a main body portion 12. Main body portion 12 includes a plurality of coil openings 14 for receiving and securing a plurality of coils 16. In an exemplary embodiment, cassette 10 includes four coil openings for receiving four coils. Of course, cassette 10 can be configured to have more or less than four coils.

Each coil 16 and main body portion 12 is manufactured separately. Alternatively, coil 16 can be configured for securement to a spark plug of an internal combustion engine. Of course, other coil configurations may be used with cassette 10.

Main body portion 12 is further defined into a lower body portion 18 and an upper body portion 20. Upper body portion 20 defines an area 22. In an assembled state, area 22 is enclosed within upper body portion 20 of cassette 10 by an encapsulant material 24 that is filled into upper body portion 20 after assembly of coil 10 is complete including the connection of the necessary electronics to the coils. In accordance with an exemplary embodiment of the present invention encapsulant 24 is an epoxy, resins, hard gels, polyurethane, silicon gel or other material capable of filling in area 22 and encapsulating the component parts of cassette 10 within area 22.

Encapsulant 24 must be able to withstand the harsh environment of an engine compartment after it has cured.

Area 22 is configured to run along the length of main body portion 20 and allows access to coil openings 14 and coils 16. In addition, a plurality of electrical connectors 26 are located at an end portion 28 of upper body portion 20. Plurality of electrical connectors 26 are in electrical communication with coils 16 as well as an engine control module for controlling high voltage output of coils 16.

In addition, a circuit board 29 or electronics for communication with coil 16 and connects 26 is placed within area 22. Alternatively circuit board 29 is a plurality of electrical connectors. Circuit board 29 is inserted into area 26 after coils 16 has been secured to main body portion 12.

Cassette 10 is configured to have a pair of openings 30 for securing cassette 10 to an appropriate location within an engine compartment of a vehicle (not shown). Openings 30 pass through encapsulant 24 as well as main body portion 12. In an exemplary embodiment, openings 30 are positioned between the outermost coil and its adjacent coil.

Openings 30 contains metal bushings 31 rigidly attached to the cassette. The bushings allow the cassette to be bolted to the engine. As an alternative, the bushings can be welded or molded into cassette 10.

In addition, and as yet another alternative, the bushings and openings are randomly positioned as dictated by the engine configuration. Moreover, the number of openings and associated bushings may also vary.

Figure 4:
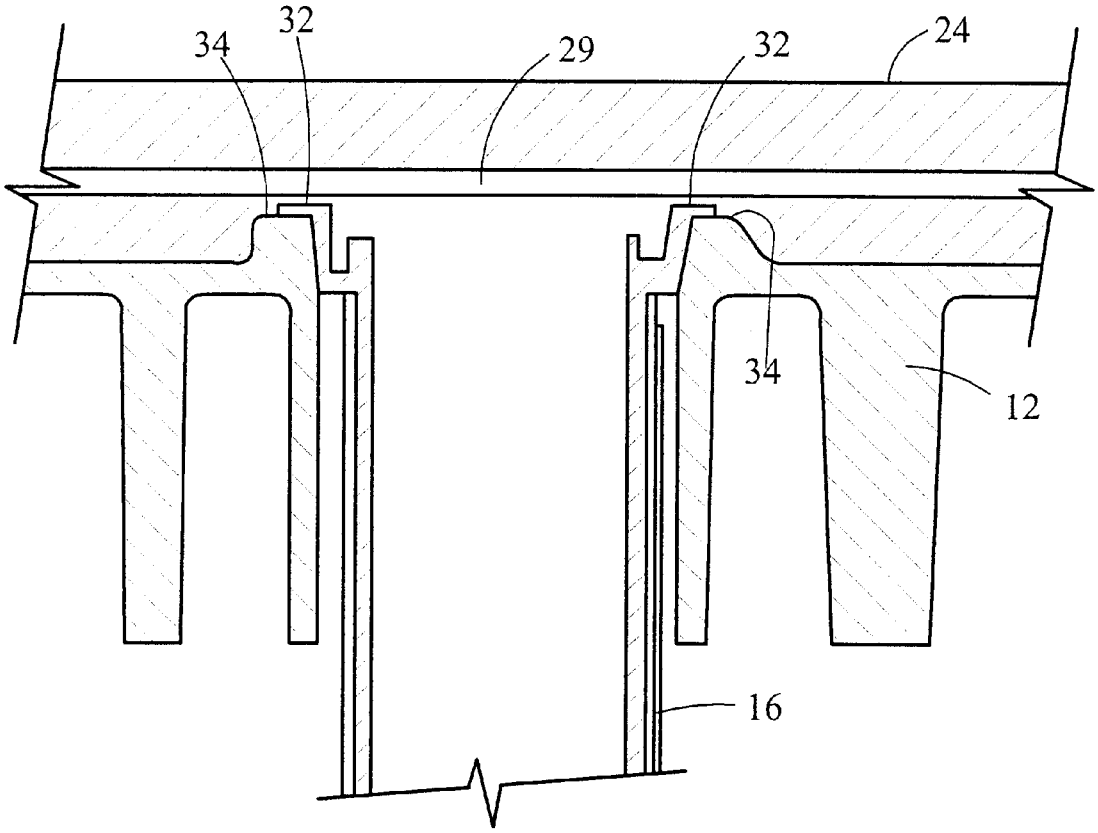
FIG. 4 is a cross-sectional view of a portion of a coil assembly constructed in accordance with an exemplary embodiment of the present invention.
Figure 5:
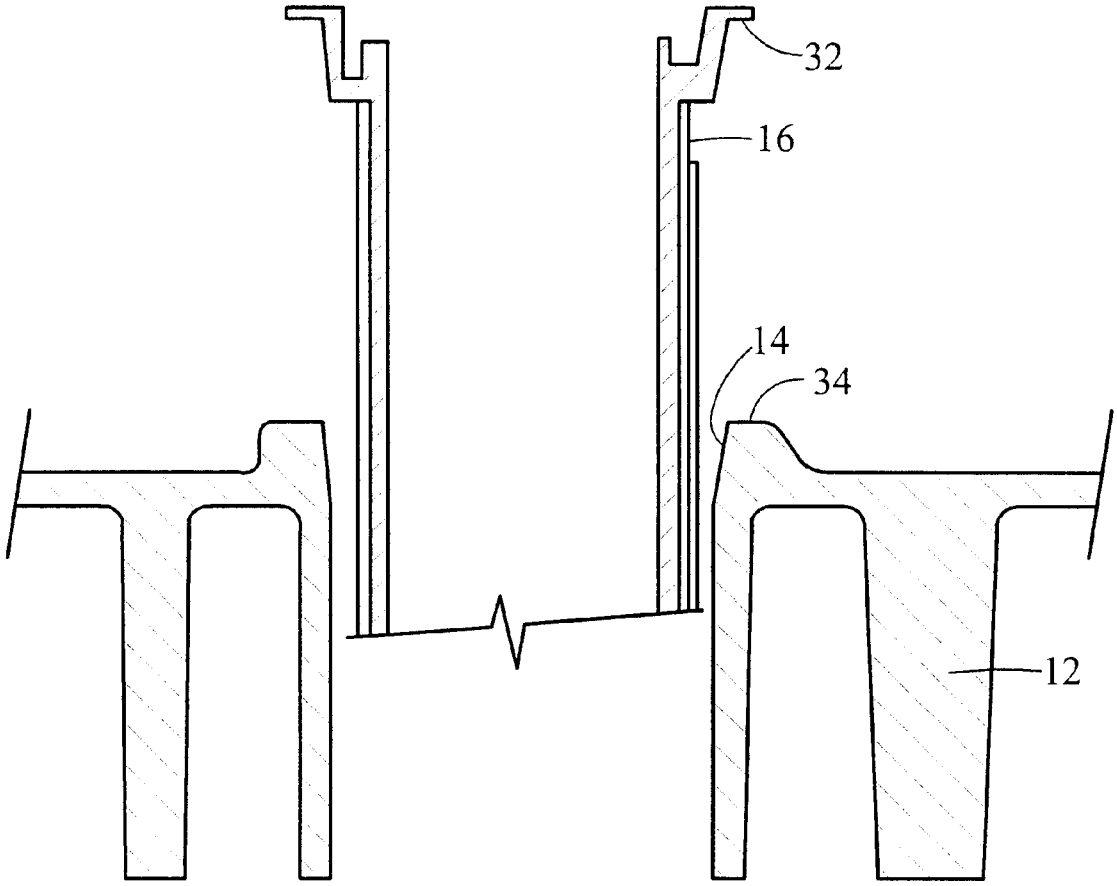
FIG. 5 is a cross-sectional view illustrating a portion of the assembly process in accordance with an exemplary embodiment of the present invention.
Figure 6:
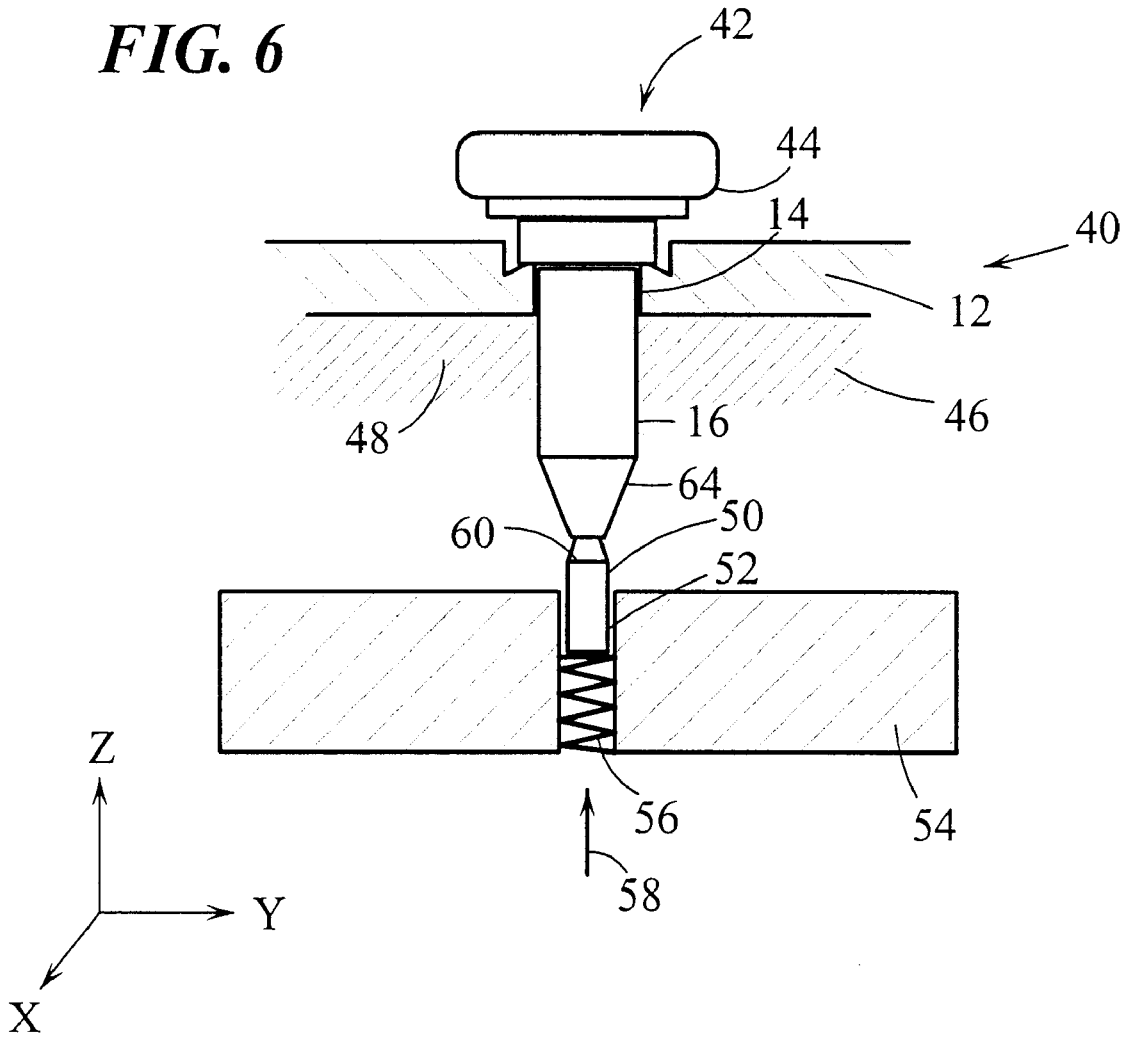
FIG. 6 is a partial cross-sectional view of an apparatus for producing a coil assembly in accordance with an exemplary embodiment of the present invention.
Figure 7:
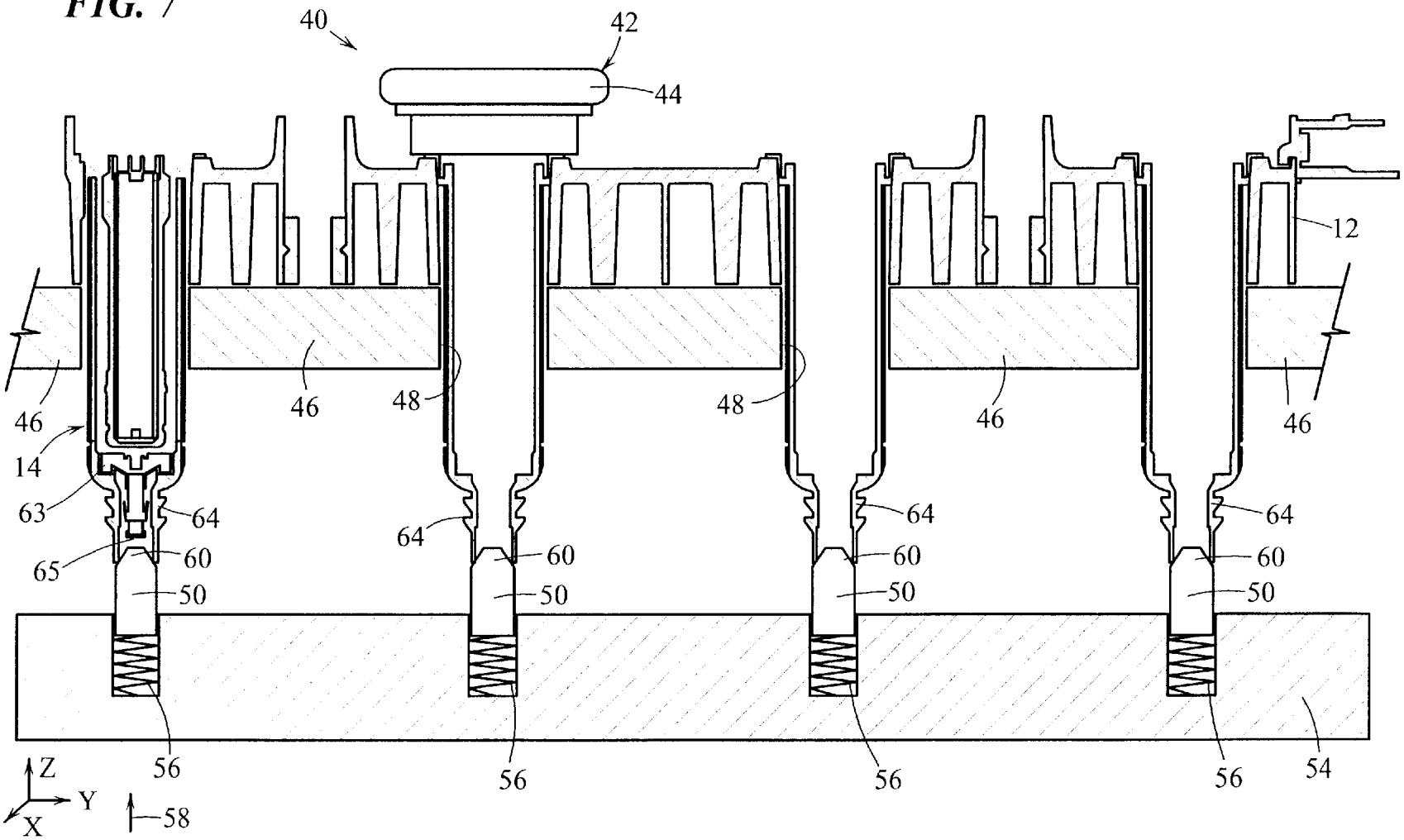
FIG. 7 is a cross-sectional view of an apparatus for producing a coil assembly in accordance with an exemplary embodiment of the present invention.

Referring now to FIGS. 4–6, the securement of coils 16 to main body portion 12 is illustrated. Each coil 16 is inserted into area 22 and into coil opening 14 of main body portion 12 until an upper flange portion 32 of coil 16 rests upon a shoulder portion 34 of coil opening 14.

The configuration of the weld horn allows it to make contact with flange 32. This allows the weld horn to cover a plastic flash (e.g. particles or debris) that may occur during the welding process. Accordingly, the plastic flash is melted into the weld joint.

In addition, and referring now in particular to FIG. 6, an apparatus 40 for the securement of coil 16 to main body portion 12 is illustrated. In an exemplary embodiment, apparatus 40 includes an ultrasonic welding device 42 comprising an ultrasonic horn 44 for making contact with a portion of coil 16. In an exemplary embodiment, ultrasonic welding device 42 is a 20 kHz machine. Of course, other machines are contemplated for use in accordance with the present invention.

Main body portion 12 of cassette 10 is supported and secured to a cassette support 46. Cassette support 46 includes an opening 48 or means for allowing the insertion of coil 16 through coil opening 14 in main body portion 12. Cassette support 46 prevents movement of main body portion 12 while coil 16 is being ultrasonically welded to main body portion 12.

During the welding procedure the ultrasonic horn is lowered downwardly until it contacts the coil. When a preset force of 10 or more pounds is met, the ultrasonic energy is activated melting be plastic weld interface and pushing the coil down to a predetermined stop. Of course, and as applications may vary, the amount of preset force may be lesser or greater than 10 pounds. Once the horn has reached the predetermined position the ultrasonic welding process stops.

Apparatus 40 also includes an alignment pin 50 for providing a means for aligning coil 16 as it is inserted through coil opening 14. The alignment of coil with respect to main body portion 12 is critical as in accordance with an exemplary embodiment, a plurality of coils are secured to main body portion 12 and once assembled cassette 10 must be configured to have each of the coils align with a plurality of spark plugs or spark plug openings.

Thus, apparatus 40 also provides an alignment feature as well as a means for securing coils 16 to main body portion 12.

In an exemplary embodiment, alignment pin 50 protrudes outwardly from an alignment pin opening 52 in a fixture support 54. A spring or other resilient member 56 is positioned within pin opening 52 in order to provide a biasing force to pin 50 in the direction of arrow 58.

Pin 50 can also move in a Z-direction (as illustrated in FIG. 6) only during the welding process. It can be adjusted in the X and Y directions during the process set up by adjusting member 54.

In addition, pin 50 has a tapered end portion 60 for locating the inside diameter of coil 16. Since pin 50 does not travel very far into the inner portion of coil 16, the tapered end portion helps to maintain coil 16 in the appropriate location during the welding process.

Also, due to the shrinkage of encapsulant 24 and the warpage of main body portion 12 (e.g. during molding) there needs to be some adjustment of the pin 50 in the X and Y directions to ensure proper positioning of coils 16 over the spark plugs in the final product.

Referring now to FIGS. 1–3 and FIG. 6 it is noted that coils 16 are secured to main body portion 12 prior to the securement of an end covering portion 62 to coils 16. End covering portion 62 is constructed out of a nonconductive flexible material such as rubber. Accordingly, end covering portion 62 is not capable of providing a rigid means for supporting coil 16 as it is ultrasonically welded to main body portion 12.

Thus, each coil is secured to main body portion 12 prior to the securement of end portions 62. Each coil 16 has an end portion 64 with a reduced inner diameter as well as components 63 of coil 16. Thus, there is a small gap 65 within end portion 64. Accordingly, and in order to provide the proper amount of support to coil 16 as it is ultrasonically welded to cassette 10 the end portion of alignment pin 50 is configured to have a tapered end. In addition, spring 56 allows pin 50 to move in the Z direction or vertically as coil 16 is secured to main body portion 12.

In an exemplary embodiment, a fixture 54 is configured to have four pins corresponding to the four coils being secured to the cassette body portion. Accordingly, and during the welding process, fixture 46 and 54 are capable of being slid or move in the X and Y directions in order to place each coil underneath the ultrasonic welding apparatus. This movement may be facilitated manually or by mechanical apparatus such as a motor, which may be driven by a controller having an operating algorithm.

Alternatively, apparatus 40 may be configured to support and retain a cassette having more or less than four coils. In yet another alternative, the ultrasonic welding device 42 may be configured for movement in the X and Y direction. In yet another alternative, a plurality of ultrasonic welding devices may be employed (e.g. one for each coil).

After all of the coils are secured to the cassette, area 22 is covered with an encapsulant in order to cover the electrical components of the same. Accordingly, the seal between main body portion 12 and coils 16 must be tight enough to prevent any leakage into the cassette. In addition, the strength of the seal between the coils and a cassette must be rigid enough to survive the potting process as well as the operating tolerances the cassette is exposed to.

In summation, the method of ultrasonically welding the coils to the cassette in accordance with an exemplary embodiment ensures that there is good seal between the coils and the cassette in addition to providing a strong enough structure to survive through the process steps required prior to the cassette potting (e.g. application of encapsulant). Additionally, this method controls the location of the high voltage tower of the coils with respect to the mounting bushings that are attached to the cassette.

The individual coils are assembled and potted prior to the assembly of the cassette. The coils are loaded into a fixture that controls the location of the mounting bushings and the high voltage end of the coils. The part of the fixture controlling the coil position is spring biased and allows movement in a vertical direction.

At the end of the welding operation the tolerance of the coil to a datum plane that goes through the bottom of the mounting bushings is kept to a low value (e.g. the tolerance of the fixture). The interference between the coils is a shear joint design. This allows the coils to take the necessary location before the plastic re-solidifies and allows for a hermetically sealed joint.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for making an ignition coil cassette, comprising:

inserting a coil through an aperture in a main body portion of said ignition coil cassette;

supporting a guide pin, said guide pin aligning said coil with respect to said main body portion, said guide pin being movably secured to a fixture support and being capable of movement in a range defined by a first position and a second position;

ultrasonically welding said coil to said body portion; and supporting said main body portion of said ignition coil cassette and maintaining the position of said main body portion during the securement of said coil to said cassette.

2. The method as in claim 1, wherein a plurality of coils are ultrasonically welded to said cassette.

3. The method as in claim 2, wherein the alignment of said coil with respect to said main body portion allows the plurality of coils of said ignition coil cassette to align with a plurality of spark plugs of an internal combustion engine.

4. The method as in claim 3, wherein each of said plurality of coils are potted prior to their securement to said ignition coil cassette and said main body portion is potted after said plurality of coils are secured to said cassette.

5. The method as in claim 1, further comprising:

covering a portion of said cassette with an encapsulant material.

6. The method as in claim 1, further comprising:

filling an area of said main body portion with an encapsulate, said encapsulant covering an electrical component of said ignition coil cassette.

7. The method as in claim 1, wherein said guide pin is spring biased with respect to said fixture support, said guide pin allowing said coil to move in the same direction as said guide pin when said coil is being secured to said main body portion.

8. The method as in claim 2, wherein said coils are each covered with an encapsulant prior to their securement to said ignition coil cassette.

9. The method as in claim 8, wherein said guide pin is spring biased with respect to said fixture support, said guide pin allowing said coil to move in the same direction as said guide pin when said coil is being secured to said main body portion.

10. The method as in claim 1, further comprising:

making contact with a portion of said coil with an ultrasonic horn of an ultrasonic welding device as said coil is secured to said main body portion.

11. The method as in claim 10, wherein said ultrasonic horn is lowered to a predetermined distance during the securement of said coil to said main body portion, said predetermined distance causing said ultrasonic horn to move said coil into a securement position, said securement position corresponding to a predetermined location for securing said coil to said main body portion.

12. The method as in claim 10, wherein said ultrasonic welding device is activated upon receiving a predetermined amount of force and said coil and said ultrasonic horn is lowered a predetermined distance during the securement of said coil to said main body portion, said predetermined distance causing said coil to move into a securement position, said securement position corresponding to a predetermined location for securing said coil to said main body portion, said ultrasonic welding device being deactivated when said ultrasonic horn travels said predetermined distance.

13. The method as in claim 5, wherein said fixture support has a plurality of guide pins, each of said plurality guide pins aligning with a coil of said ignition coil cassette.

14. The method as in claim 13, wherein said guide pin allows for warpage of a seal between said coil and said main body portion as said seal cures.

15. A method for making an ignition coil cassette, comprising:

inserting a coil through an aperture in a main body portion of said ignition coil cassette until an upper flange portion of said coil makes contact with a shoulder of said aperture;

supporting a guide pin, said guide pin aligning said coil with respect to said main body portion, said guide pin being movably secured to a fixture support and being capable of movement in a range defined by a first position and a second position;

ultrasonically welding said coil to said body portion; and supporting said main body portion of said ignition coil cassette and maintaining the position of said main body portion during the welding of said upper flange portion to said cassette.

* * * * *